US007759851B2

(12) United States Patent
Dijon et al.

(10) Patent No.: US 7,759,851 B2
(45) Date of Patent: Jul. 20, 2010

(54) CATHODE STRUCTURE FOR EMISSIVE SCREEN

(75) Inventors: Jean Dijon, Champagnieu (FR); Adeline Fournier, Novt Saint Martin (FR); Brigitte Montmayeul, Bernin (FR)

(73) Assignee: Commissariat a l'Energie Atomique, Paris (FR)

( * ) Notice: Subject to any disclaimer, the term of this patent is extended or adjusted under 35 U.S.C. 154(b) by 0 days.

(21) Appl. No.: 10/485,669

(22) PCT Filed: Feb. 18, 2003

(86) PCT No.: PCT/FR03/00530

§ 371 (c)(1),
(2), (4) Date: Mar. 15, 2004

(87) PCT Pub. No.: WO03/071571

PCT Pub. Date: Aug. 28, 2003

(65) Prior Publication Data

US 2004/0256969 A1 Dec. 23, 2004

(30) Foreign Application Priority Data

Feb. 19, 2002 (FR) ..... 02 02075

(51) Int. Cl.
*H01J 17/49* (2006.01)
*H01J 1/62* (2006.01)
*H01J 9/02* (2006.01)

(52) U.S. Cl. ..... 313/310; 313/495; 313/496; 313/497

(58) Field of Classification Search ..... 313/309–311, 313/495–497

See application file for complete search history.

(56) References Cited

U.S. PATENT DOCUMENTS 5,679,043 A 10/1997 Kumar (Continued)

FOREIGN PATENT DOCUMENTS

EP 0 503 638 3/1992

(Continued)

OTHER PUBLICATIONS

International Search Report, PCT/FR 03/00530, International filing date Feb. 18, 2003, Search Report mailed Jun. 26, 2003.

(Continued)

*Primary Examiner*—Nimeshkumar D. Patel
*Assistant Examiner*—Natalie K Walford
(74) *Attorney, Agent, or Firm*—Nixon Peabody LLP

(57) ABSTRACT

This invention relates to a triode type cathode structure comprising, in superposition, an electrode forming a cathode (13) and supporting means made of an electron emitting material in the form of a layer (14), an electrical insulation layer (11) and a grid electrode (15), an opening (12) formed in the grid electrode and in the electrical insulation layer exposing the means made of an electron emitting material. The means made of an electron emitting material (14) are located in the central part of the opening of the grid electrode (15), this opening being in the form of a slit and the means made of an electron emitting material exposed by the slit being composed of elements aligned along the longitudinal axis of the slit.

20 Claims, 6 Drawing Sheets

U.S. PATENT DOCUMENTS

| | | | | |
|---|---|---|---|---|
| 5,717,285 | A | 2/1998 | Meyer et al. | |
| 5,739,628 | A | 4/1998 | Takada | |
| 5,757,138 | A | 5/1998 | Tsai | |
| 5,821,679 | A | 10/1998 | Makishima | |
| 6,062,931 | A * | 5/2000 | Chuang et al. | 445/24 |
| 6,078,133 | A * | 6/2000 | Menu et al. | 313/310 |
| 6,097,139 | A | 8/2000 | Tuck et al. | |
| 6,100,628 | A * | 8/2000 | Coll et al. | 313/310 |
| 6,323,587 | B1 | 11/2001 | Zhang et al. | |
| 6,420,726 | B2 * | 7/2002 | Choi et al. | 257/10 |
| 6,437,503 | B1 | 8/2002 | Konuma | |
| 6,445,124 | B1 * | 9/2002 | Asai et al. | 313/495 |
| 6,455,989 | B1 * | 9/2002 | Nakada et al. | 313/309 |
| 6,472,802 | B1 * | 10/2002 | Choi et al. | 313/309 |
| 6,476,408 | B1 * | 11/2002 | Legagneux et al. | 257/10 |
| 6,486,609 | B1 * | 11/2002 | Shiratori et al. | 315/169.3 |
| 6,522,053 | B1 * | 2/2003 | Iwase et al. | 313/310 |
| 6,650,061 | B1 | 11/2003 | Urayama et al. | |
| 6,774,548 | B2 * | 8/2004 | Fran et al. | 313/309 |
| 7,030,550 | B2 * | 4/2006 | Ide et al. | 313/497 |
| 2002/0167266 | A1 * | 11/2002 | Hirasawa et al. | 313/496 |

FOREIGN PATENT DOCUMENTS

| | | | |
|---|---|---|---|
| EP | 0 616 356 | | 3/1994 |
| EP | 0 789 382 | | 2/1996 |
| EP | 1 037 250 | | 3/2000 |
| EP | 1 164 618 | | 3/2000 |
| EP | 1 115 134 | | 1/2001 |
| EP | 1 174 899 | | 7/2001 |
| FR | 2 780 808 | | 7/1998 |
| JP | 7-249368 | | 9/1995 |
| JP | 10 092 294 | | 4/1998 |
| JP | 2000243218 | | 9/2000 |
| JP | 2000251614 | | 9/2000 |
| JP | 2000268705 | A | 9/2000 |
| JP | 2001-43792 | | 2/2001 |
| JP | 2001101966 | A | 4/2001 |
| WO | 94/15352 | | 7/1994 |
| WO | WO 0261789 | A1 * | 8/2002 |

OTHER PUBLICATIONS

Office Action issued in corresponding Japanese Patent Application No. 2003-570380, dated Dec. 9, 2008.

Office Action issued in corresponding European Patent Application No. 03717409.1-2208, dated Jan. 20, 2009.

* cited by examiner

CATHODE STRUCTURE FOR EMISSIVE SCREEN

CROSS-REFERENCE TO RELATED APPLICATION

This application claims priority based on International Patent Application No. PCT/FR03/00530, entitled "CATHODE STRUCTURE FOR EMISSIVE SCREEN" by Jean Dijon, Adeline Fournier and Brigitte Montmayeul, which claims priority of French Application No. 02/02075, filed on Feb. 19, 2002, and which was not published in English.

TECHNICAL DOMAIN

The invention relates to a cathode structure that can be used in a flat field emission screen.

STATE OF THE PRIOR ART

A display device by cathode luminescence excited by field emission comprises a cathode or electron emitting structure and an anode facing it covered by a luminescent layer. The anode and the cathode are separated by a space in which a vacuum has been created.

The cathode is either a micro-tip based source, or a source based on an emissive layer with low threshold field. The emissive layer may be a carbon nanotube layer or other structures based on carbon or based on other materials or multilayers (AlN, BN).

The cathode structure may be of the diode type or of the triode type. Document FR-A-2 593 953 (corresponding to U.S. Pat. No. 4,857,161) discloses a process for manufacturing a cathode luminescent display device excited by field emission. The cathode structure is of the triode type. The electron emitting material is deposited on an exposed conducting layer at the bottom of the holes formed in an insulation layer that supports an electron extraction grid.

FIG. 1 diagrammatically shows a sectional view of a triode type cathode structure according to the known art, for a cathode luminescent display device excited by field emission. A single emission device is shown in this figure. A layer 1 made of an electrically insulating material is perforated by a circular hole 2. A conducting layer 3 supporting a layer 4 made of an electron emitting material is deposited at the bottom of the hole 2. The top face of the insulation layer 1 supports a metallic layer 5 forming the extraction grid and surrounding the hole 2. In this structure, the emissive layer 4 tends to cause short circuits between the grid 5 and the conducting layer or cathode 3. This tendency arises particularly if the emissive layer is composed of carbon nanotubes. The electric field is maximum at the edge of the hole, and at the emissive layer it comprises an important lateral component $E_L$ (parallel to the plane of the cathode) (comparable to the perpendicular component $E_x$ of the electric field) that makes the electron beam diverge and induces resolution problems on the screen. This is a serious disadvantage when the anode—cathode distance increases and it may make the screen more complex by adding other grids necessary to focus the electron beam.

SUMMARY OF THE INVENTION

It is here proposed a cathode structure with an emissive layer, of the triode type, for which the electrons emitted by the emissive layer are subjected to a weak lateral electric field, which minimises the risks of short circuits between the grid and the cathode and which limits divergence of the electron beam emitted by the emissive layer.

Therefore, the purpose of the invention is a triode type cathode structure comprising, in superposition, an electrode forming a cathode and supporting means made of an electron emitting material in the form of a layer, an electrical insulation layer and a grid electrode, an opening formed in the grid electrode and in the electrical insulation layer exposing the means made of an electron emitting material, the means made of an electron emitting material being located in the central part of the opening of the grid electrode, characterised in that the opening is in the form of a slit, the means made of an electron emitting material exposed by the slit being composed of at least two elements aligned along the longitudinal axis of the slit.

According to one advantageous embodiment, the opening formed in the grid electrode and in the electrical insulation layer is practically rectangular, and said elements made of an electron emitting material are also approximately rectangular.

According to another advantageous embodiment, a resistive layer is inserted between the electrode forming the cathode and the elements made of an electron emitting material.

Preferably, the elements made of an electron emitting material are separated from the grid electrode by a distance greater than the size of the objects from which the electron emitting material is made.

The electron emitting material may be composed of carbon nanotubes.

Advantageously, the elements made of an electron emitting material are separated from the grid electrode by a distance such that the parallel component of the electric field is at least ten times weaker than the perpendicular component of this field.

Another purpose of the invention is a flat field emission screen comprising several cathode structures like that defined above.

BRIEF DESCRIPTION OF THE DRAWINGS

The invention will be better understood and other advantages and special features will become clearer after reading the following description, given as a non-limitative example with the appended drawings among which.

DETAILED DESCRIPTION OF EMBODIMENTS OF THE INVENTION

Figure 1:
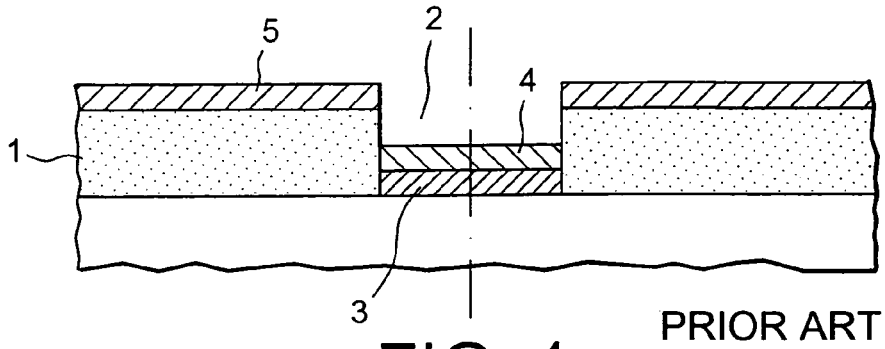
FIG. 1, already described, is a sectional view through a triode type cathode structure according to the known art.
Figure 2:
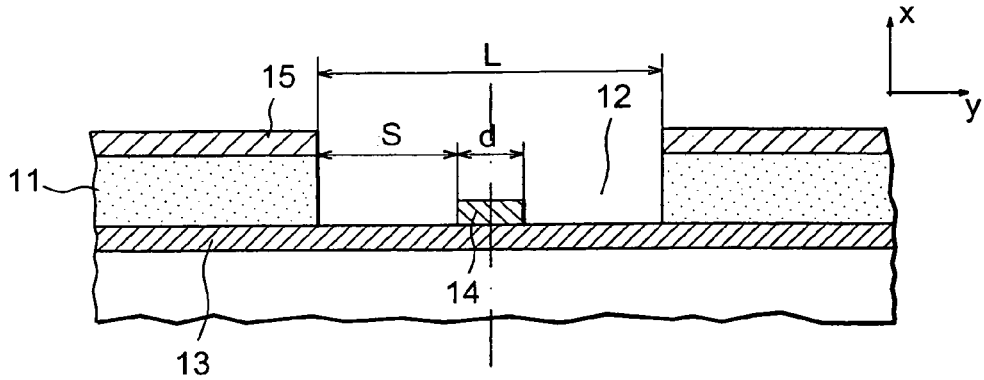
FIG. 2 is a sectional view of a triode type cathode structure according to the invention.

FIG. 2 is a diagrammatic and sectional view of a triode type cathode structure according to the invention. This cathode structure comprises, in superposition, a conducting layer or cathode 13 supporting a layer 11 made of an electrically insulating material and a metallic layer 15 forming an electron extraction grid. The insulation layer 11 and the metallic layer 15 are perforated by a slit 12 exposing the cathode 13 with width L. Elements made of an electron emitting material 14 are arranged in the central part of the slit 12 along the longitudinal axis of the slit, in the form of a layer (the figure only shows one element). The width d of the emissive elements 14 is small compared with the width L of the slit 12. The distance separating the metallic layer 15 from the emissive elements 14 is called S. The slit 12 may be rectangular.

Figure 3:
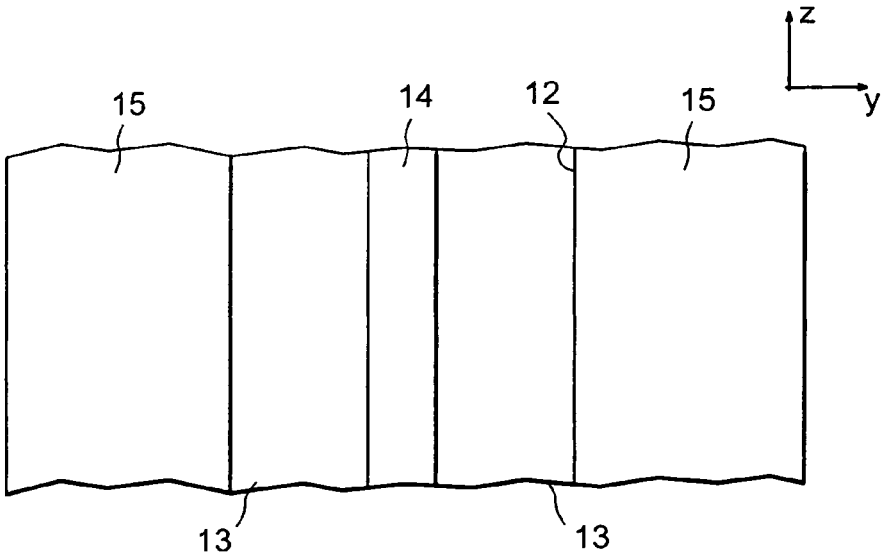
FIG. 3 is a top view of part of a triode type cathode structure according to the invention.

FIG. 3 is a partial top view of the cathode structure shown in FIG. 2 in the case in which the slit 12 is rectangular. The slit 12 is then a groove with width L and for which the dimension along the Z axis is the same as the dimension of a screen pixel.

This slit geometry is better than the circular geometry. Due to symmetry, there is no lateral component of the electric field along the Z axis, therefore the emissive surface satisfying the condition $E_L \ll E_x$ is more important in this geometry than in the cylindrical geometry. In a cylindrical geometry, the ratio between the emissive area and the hole area is equal to $(d/L)^2$. In a rectangular geometry, this ratio is equal to d/L. Since d/L is less than 1, the ratio d/L is therefore always greater than $(d/L)^2$ which results in a much brighter screen.

Another advantageous embodiment is the embodiment in which a resistive layer is added between the emissive layer and the cathode. In this case, the resistive layer protects the grid and the cathode from a short circuit. Moreover, this resistive layer is very favourable to operation of the screen as described in document EP-A-0 316 214 (corresponding to U.S. Pat. No. 4,940,916).

Figure 4:
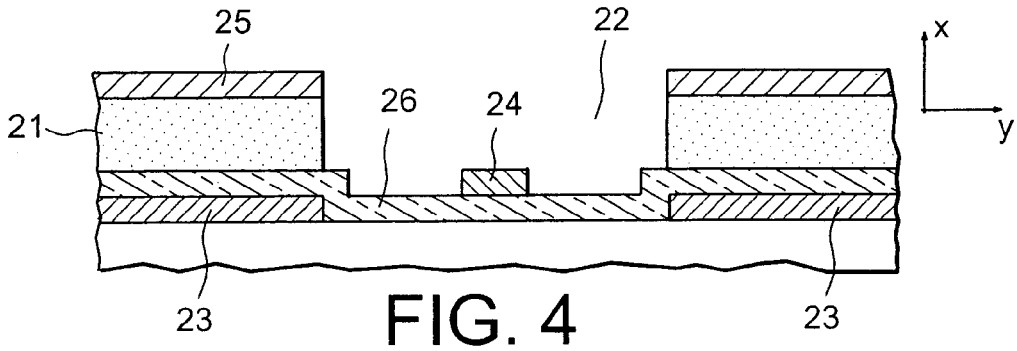
FIG. 4 is a sectional view through another triode type cathode structure according to the invention.

FIG. 4 shows a diagrammatic and sectional view of a triode type cathode structure according to the invention with a resistive protection layer. This cathode structure comprises, in superposition, a cathode 23 supporting a resistive layer 26, an insulation layer 21 and a metallic layer 25 forming an electron extraction grid. A slit 22 exposes the resistive layer 26. Elements made of an emissive material 24 in the central part of this slit 22 and along the longitudinal axis of the slit are supported on the resistive layer 26. The figure only shows one element.

The fact that the emissive area is located over a narrow width at the centre of the slit or the groove, enables directive emission of electrons and provides a solution to resolution problems. This is due to the very low value of the parallel component of the electric field ($E_L/E_x<0.1$) in the area in which the emissive elements are located.

Figure 5:
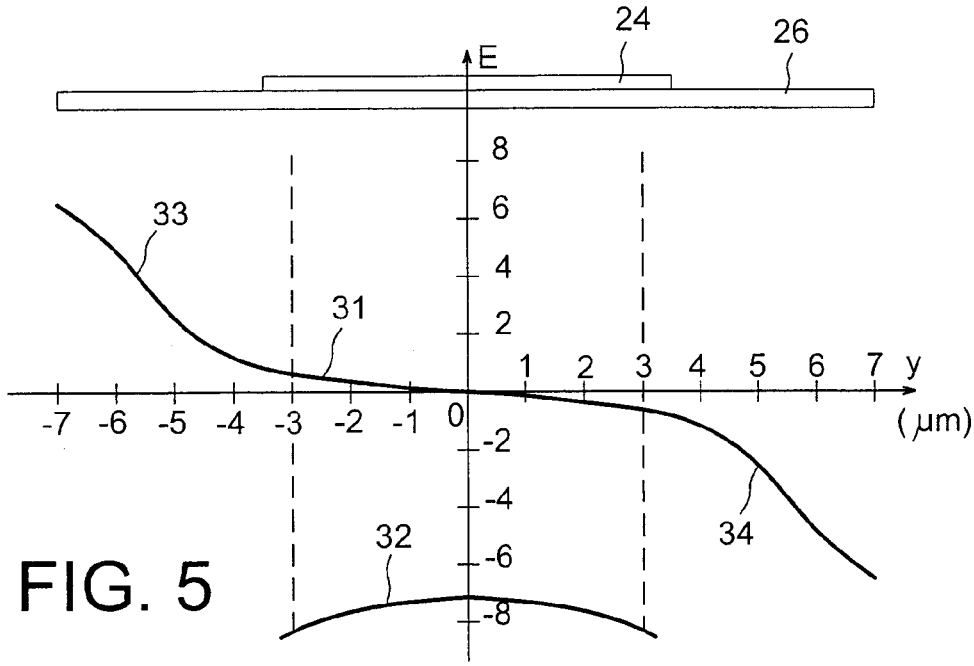
FIG. 5 is a diagram showing the spatial distribution of the electric field for a triode type cathode structure according to the invention.

The diagram in FIG. 5 shows the spatial distribution of the electric field for a cathode structure according to the invention. The diagram is plotted along the Y axis, the emissive element 24 and the resistive layer 26 being represented on the diagram. The spatial distribution of the electric field E is calculated for a hole width L equal 14 μm. The width d in the central area is equal to 6 μm, the lateral component $E_y$, reference 31 is less than 10 times the minimum value of the normal component reference 32. Outside the emissive area, the intensity of the lateral field reference 33 and 34 is comparable to the normal field. The calculation is made for a voltage of 60 V on the grid.

Thus, problems inherent to structures according to the prior art are overcome. Grid-cathode short circuit problems are eliminated by central positioning and the small size of emissive elements compared with the dimension of the groove or the slit and possibly by the presence of a resistive layer. The electric field induced by the grid is uniform and only comprises very weak lateral components compared with the vertical component of the field.

Figure 6:
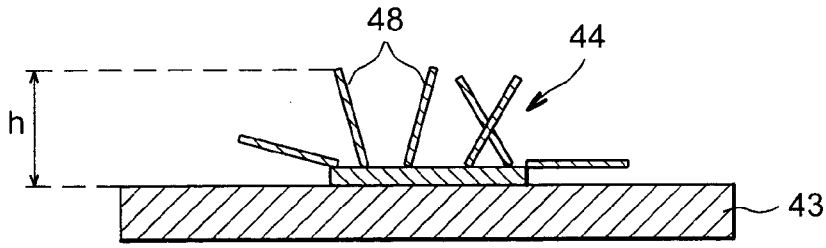
FIG. 6 is a figure explaining dimensions to be respected for a triode type cathode structure according to the invention.

A minimum value for the distance S separating the metallic grid layer from emissive elements can be found empirically (see FIG. 2). This distance is greater than the size h of objects making up the emissive layer. This is schematically represented in FIG. 6 in which reference 43 denotes a cathode and reference 44 denotes an emissive layer. For example, the emissive layer 44 is composed of carbon nanotubes 48. In this case, the distance S is greater than the average length h of the carbon nanotubes. Considering the large dispersions in the lengths of the nanotubes, it is preferable to multiply this distance by a factor of the order of 2 or 3.

For 1 to 2 μm long nanotubes, the distance S may be of the order of 3 to 4 μm. These values are given for guidance and are not limitative. It can be checked that the lateral component of the electric field is very weak compared with the normal component for these dimensions.

FIGS. 7A to 7F illustrate a first process for making a triode type cathode structure according to the invention, this process using vacuum deposition and photolithography techniques.

Figure 7A:
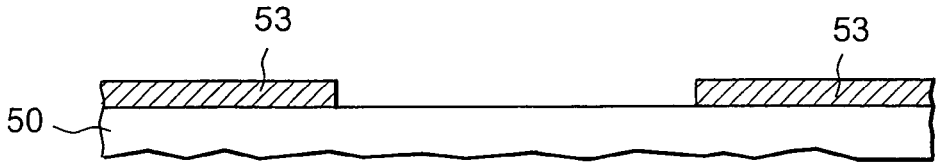
FIGS. 7A to 7F illustrate a first process for manufacturing a triode type cathode structure according to the invention.

The cathode conductor is obtained by depositing a conducting material, for example molybdenum, niobium, copper or ITO, onto a support 50 (see FIG. 7A). The deposition of the conducting material is etched in strips, typically 10 μm wide and with a pitch equal to 25 μm. FIG. 7A shows two strips that will be combined to form a cathode electrode 53.

Figure 7B:
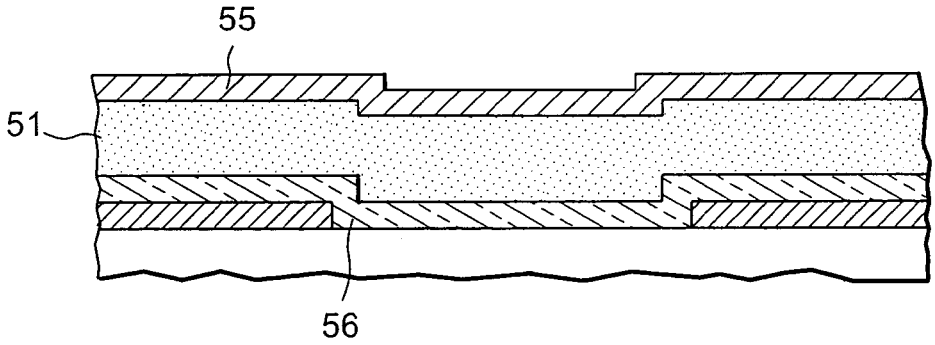

Several deposits are then made as shown in FIG. 7B: a 1.5 μm thick resistive layer 56 of amorphous silicon, followed by a 1 μm thick insulation layer 51 made of silica or silicon nitride, and finally a metallic layer 55 made of niobium or molybdenum that will form the electronic extraction grid.

Figure 7C:
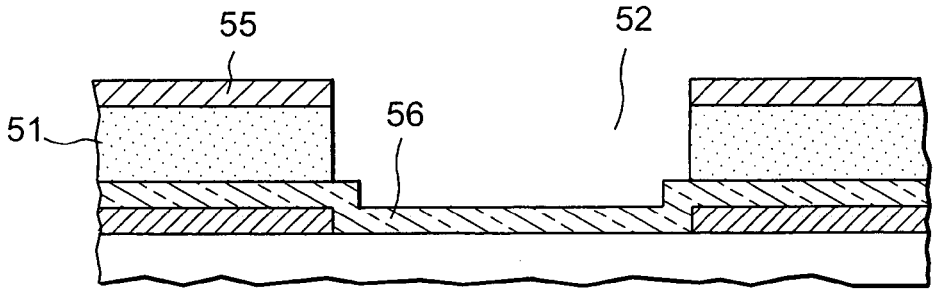

The metallic layer 55 and the insulation layer 51 are then etched simultaneously in a 15 μm wide slit or trench 52 until the resistive layer 56 is exposed. This is shown in FIG. 7C.

Figure 7D:
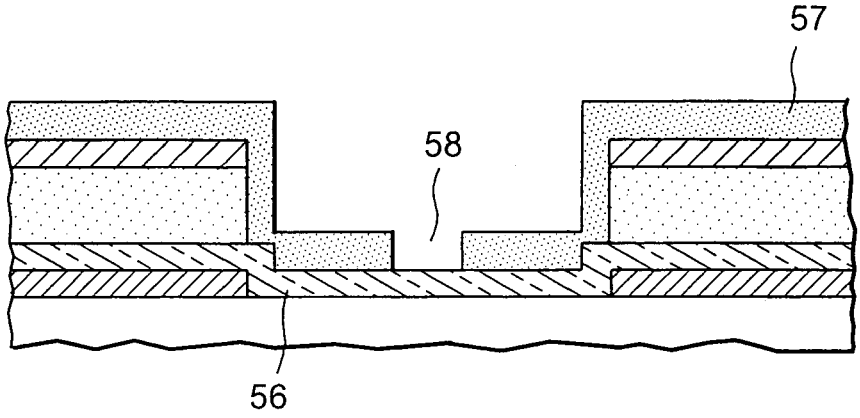

FIG. 7D shows the structure obtained after deposition of a sacrificial layer 57 made of resin and the formation of 6 μm wide and 10 to 15 μm long openings 58 in the layer 57, exposing the resistive layer 56. The width of the openings 58 corresponds to the width of the emissive layer to be made.

Figure 7E:
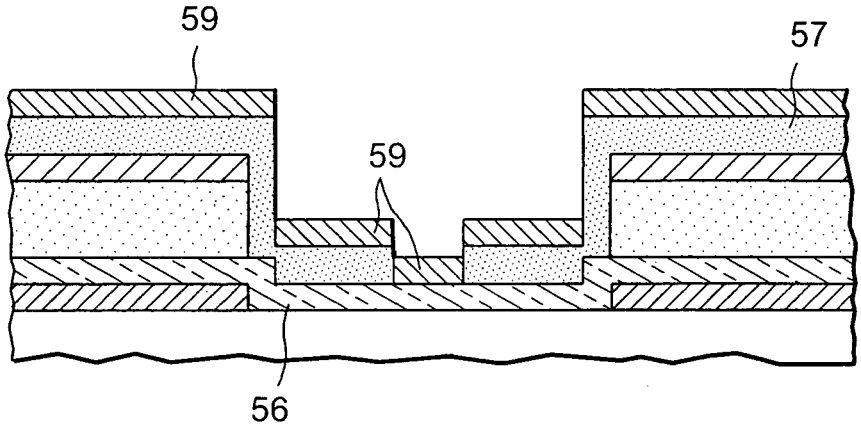

A catalytic deposition of iron, cobalt or nickel is then made on the structure. The catalytic deposit may advantageously be replaced by deposition of a growth multi-layer that may for example be a stack comprising TiN or TaN and a catalyst material such as Fe, Co, Ni or Pt. As shown in FIG. 7E, this catalytic deposit provokes the formation of a discontinuous growth layer 59 on the sacrificial layer 57 and on the exposed part of the resistive layer 56.

Figure 7F:
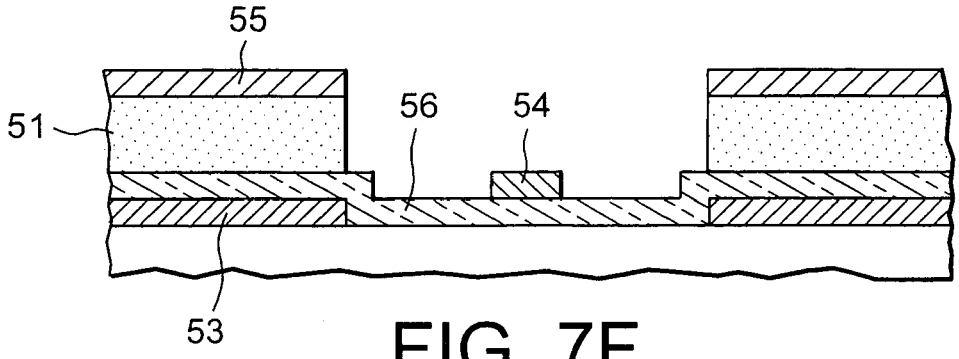

The sacrificial layer is then eliminated using a "lift-off" technique that causes elimination of parts of the growth layer located on this sacrificial layer. Parts of the growth layer remain in the central part of the resistive layer 56. This enables growth of emissive layers 54. FIG. 7F only shows one element.

FIGS. 8A to 8F illustrate a second process for manufacturing a triode type cathode structure according to the invention, this process using vacuum deposition and photolithography techniques. It is a self-aligned process.

Figure 8A:
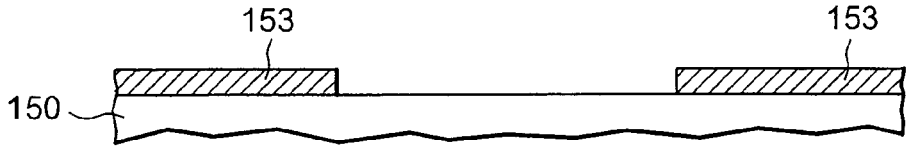
FIGS. 8A to 8F illustrate a second process for manufacturing a triode type cathode structure according to the invention.

The cathodic conductor is obtained by deposition of a conducting material, for example molybdenum, niobium, copper or ITO, on a support 150 (see FIG. 8A). The deposition of conducting material is etched in strips, typically 10 μm wide with a pitch equal to 25 μm. FIG. 8A shows two strips that will be combined to form a cathode electrode 153.

Figure 8B:
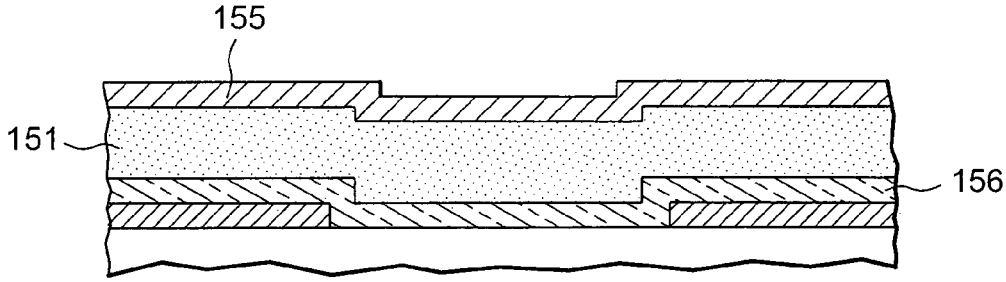

Several deposits are then made as shown in FIG. 8B; a 1.5 μm thick resistive layer 156 made of amorphous silicon, followed by a 1 μm thick insulation layer 151 made of silica or silicon nitride, and finally a metallic layer 155 made of niobium or molybdenum that will form the electron extraction grid.

Figure 8C:
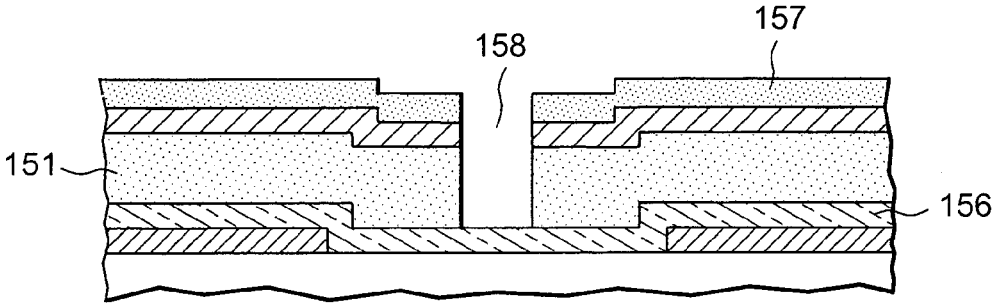

After deposition of a sacrificial layer 157, the metallic layer 155 and the insulation layer 151 are then simultaneously etched with an opening 158 for each emissive element to be made, with dimensions equal to the dimensions of the emissive elements to be made and until the resistive layer 156 is exposed. Each opening 158 may be 6 μm wide and 15 μm long. This is shown in FIG. 8C.

Figure 8D:
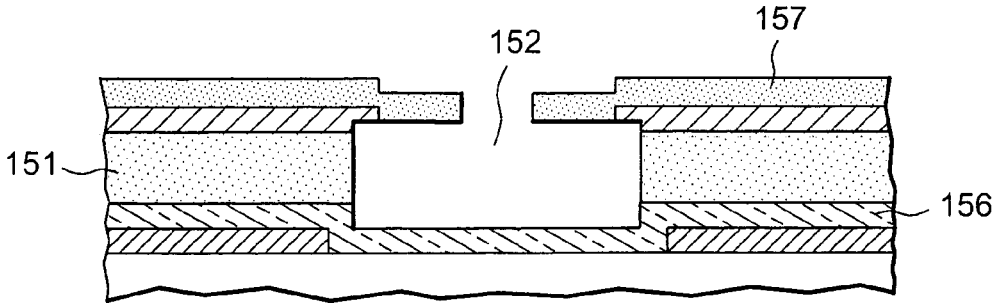

Lateral etching of the insulation layer 151 is then done from the trench 158 to obtain the required slit 152. This is shown in FIG. 8D. Part of the sacrificial layer 157 is then overhanging over the slit 152. The slit and the grid are then self-aligned with the emissive areas.

Figure 8E:
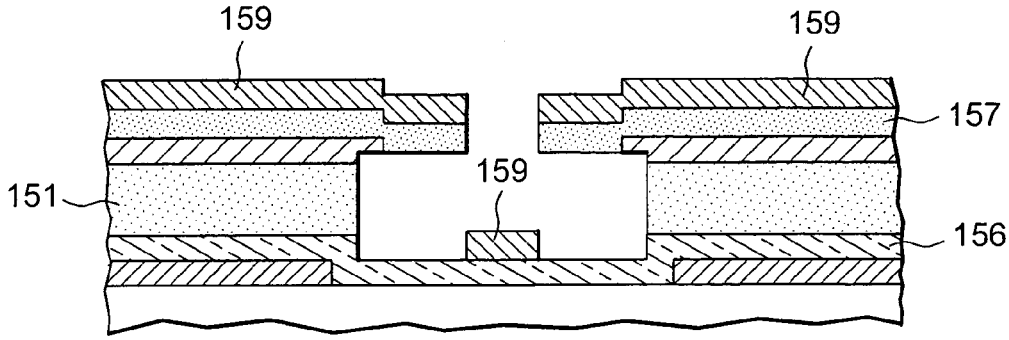

FIG. 8E shows the structure obtained after depositing a layer of catalyst material 159. The deposit is made on the sacrificial layer 157 and on the exposed part of the resistive layer 156. The catalyst may be iron, cobalt or nickel. The catalytic deposit may advantageously be replaced by the deposit of a growth multi-layer that may for example be a stack comprising TiN or TaN and a catalyst material such as Fe, Co, Ni or Pt.

Figure 8F:
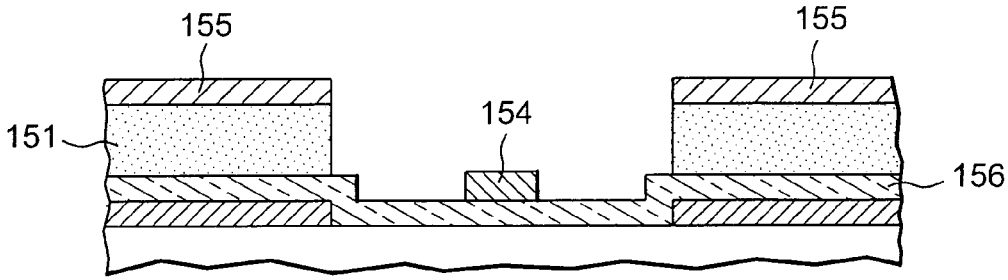

A lift-off operation is then performed on the sacrificial layer, which eliminates the part of the layer of catalyst material supported by the sacrificial layer. Parts of the growth layer remain on the central part of the resistive layer 156. This enables growth of emissive layers 154. FIG. 8F only shows one element.

Figure 9:
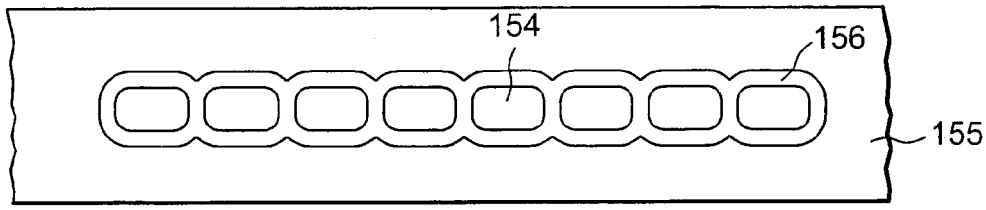
FIG. 9 shows a more complete top view of a triode type cathode structure according to the invention.

FIG. 9 shows a more complete top view of a triode type cathode structure according to the invention. This structure was obtained by the second manufacturing process. The grid electrode 155, emissive elements 154 and the resistive layer 156 can all be recognised. The slits thus manufactured are not perfectly rectangular. They are slightly festooned, which in no way hinders operation of the device.

The invention claimed is:

1. A triode type cathode structure comprising, in superposition:

an electrode forming a cathode;

an electrical insulation layer and a grid electrode;

a slit formed in the grid electrode and in the electrical insulation layer up to the electrode forming a cathode, the slit having a longitudinal axis and a length dimension greater than a width dimension, the slit having a bottom and walls; and the slit containing a plurality of separate emissive elements made of an electron emitting material, each of the emissive elements being in the form of a layer, the plurality of separate emissive elements being located on the electrode forming a cathode, in the central part of the slit such that the plurality of emissive elements do not contact the walls of the slit, and the plurality of emissive elements being aligned along the longitudinal axis of the slit.

2. Triode type cathode structure according to claim 1, wherein the slit formed in the grid electrode and in the electrical insulation layer is practically rectangular, said elements made of an electron emitting material are also approximately rectangular.

3. Triode type cathode structure according to claim 1, wherein a resistive layer is inserted between the electrode forming a cathode and the elements made of an electron emitting material.

4. Triode type cathode structure according to claim 1, wherein the elements made of an electron emitting material are separated from the grid electrode by a distance greater than the size of the objects from which the electron emitting material is made.

5. Triode type cathode structure according to claim 1, wherein each of said plurality of emissive elements made of the electron emitting material includes:

a plurality of carbon nanotubes.

6. Triode type cathode structure according to claim 1, wherein the elements made of an electron emitting material are separated from the grid electrode by a distance such that the parallel component of the electric field is at least ten times weaker than the perpendicular component of this field.

7. Triode type cathode structure according to claim 1, wherein a length of the slit along the longitudinal axis thereof corresponds to a screen pixel.

8. Triode type cathode structure according to claim 1, wherein said plurality of emissive elements are aligned in a single row along the longitudinal axis of the slit.

9. Triode type cathode structure according to claim 1, wherein the electrode forming a cathode is offset in the superposition with respect to the emissive elements such that the emissive elements are not situated above the electrode forming a cathode.

10. A flat field emission screen, comprising a plurality of triode type cathode structures, each triode type cathode structure comprising, in superposition:

an electrode forming a cathode;

an electrical insulation layer and a grid electrode;

a slit formed in the grid electrode and in the electrical insulation layer up to the electrode forming a cathode, the slit having a longitudinal axis and a length dimension greater than a width dimension, the slit having a bottom and walls; and the slit containing a plurality of separate emissive elements made of an electron emitting material, each of the emissive elements being in the form of a layer, the plurality of separate emissive elements being located on the electrode forming a cathode, in the central part of the slit such that the plurality of emissive elements do not contact the walls of the slit, and the plurality of emissive elements being aligned along the longitudinal axis of the slit.

11. Flat field emission screen according to claim 10, wherein a length of the slit along the longitudinal axis thereof corresponds to a screen pixel.

12. Flat field emission screen according to claim 10, wherein said plurality of emissive elements are aligned in a single row along the longitudinal axis of the slit.

13. Flat field emission screen according to claim 10, wherein the electrode forming a cathode is offset in the superposition with respect to the emissive elements such that the emissive elements are not situated above the electrode forming a cathode.

14. A triode type cathode structure comprising, in superposition:

an electrode forming a cathode;

an electrical insulation layer and a grid electrode;

a slit formed in the grid electrode and in the electrical insulation layer up to the electrode forming a cathode, the slit having a longitudinal axis and a length dimension greater than a width dimension, the slit having a bottom and walls; and the slit containing a plurality of separate emissive elements, each of the emissive elements comprising a plurality of carbon nanotubes, the plurality of separate emissive elements being located on the electrode forming a cathode, in the central part of the slit such that the plurality of emissive elements do not contact the walls of the slit, and the plurality of emissive elements being aligned along the longitudinal axis of the slit.

15. Triode type cathode structure according to claim 14, wherein said plurality of emissive elements are aligned in a single row along the longitudinal axis of the slit.

16. Triode type cathode structure according to claim 14, wherein the electrode forming a cathode is offset in the superposition with respect to the emissive elements such that the emissive elements are not situated above the electrode forming a cathode.

17. A flat field emission screen comprising a plurality of triode type cathode structures, each triode type cathode structure comprising, in superposition:

an electrode forming a cathode;

an electrical insulation layer and a grid electrode;

a slit formed in the grid electrode and in the electrical insulation layer up to the electrode forming a cathode, the slit having a longitudinal axis and a length dimension greater than a width dimension, the slit having a bottom and walls; and the slit containing a plurality of separate emissive elements, each of the emissive elements comprising a plurality of carbon nanotubes, the plurality of separate emissive elements being located on the electrode forming a cathode, in the central part of the slit such that the plurality of emissive elements do not contact the walls of the slit, and the plurality of emissive elements being aligned along the longitudinal axis of the slit.

18. Flat field emission screen according to claim 17, wherein a length of the slit along the longitudinal axis thereof corresponds to a screen pixel.

19. Flat field emission screen according to claim 17, wherein said plurality of emissive elements are aligned in a single row along the longitudinal axis of the slit.

20. Flat field emission screen according to claim 17, wherein the electrode forming a cathode is offset in the superposition with respect to the emissive elements such that the emissive elements are not situated above the electrode forming a cathode.

* * * * *